United States Patent [19]

Iwai et al.

[11] 4,211,484

[45] Jul. 8, 1980

[54] DRUM CLEANING BLADE FOR IMAGE TRANSFER TYPE ELECTROPHOTOGRAPHIC COPYING MACHINE

[75] Inventors: Fumio Iwai; Masakazu Kokiso; Junichi Koiso; Tamio Ogino, all of Hachioji, Japan

[73] Assignee: Konishiroku Photo Industry Co., Ltd., Tokyo, Japan

[21] Appl. No.: 965,025

[22] Filed: Nov. 30, 1978

[30] Foreign Application Priority Data

Dec. 8, 1977 [JP] Japan ..... 52-146639

[51] Int. Cl.[2] ..... G03G 21/00

[52] U.S. Cl. ..... 355/15; 15/256.51

[58] Field of Search ..... 355/3 R, 15; 15/256.51, 15/256.52

[56] References Cited

U.S. PATENT DOCUMENTS 3,927,936 12/1975 Komori et al. ..... 355/15

4,056,315 11/1977 Ariyama et al. ..... 355/15 X

*Primary Examiner*—Fred L. Braun

*Attorney, Agent, or Firm*—Bierman & Bierman

[57] ABSTRACT

A drum cleaning blade for a image transfer type of copying machine which has a rotatable drum provided thereon with a photo-sensitive cylindrical layer in which an electrostatic latent image of an original to be copied is produced and developed by a toner powder. The blade comprises a main sheet-like center portion having a straight lower edge and a pair of side portions from which triangular projections extend forwardly, respectively. The inner edges of the triangular projections are slanted outwardly.

The side portions in which the triangular projections are formed are separated from the main portion through cuts.

The lower edge as well as the slanted inner edges of the triangular projections are caused to bear on the outer cylindrical surface of the drum thereby to scrape off the toner particles remaining as deposited on the drum surface after the transfer processing of the toner image to a transfer sheet. The inner slanted edges of the triangular projections serve to prevent the toner particles as scraped off from being scattered laterally outwardly from the drum.

2 Claims, 4 Drawing Figures

DRUM CLEANING BLADE FOR IMAGE TRANSFER TYPE ELECTROPHOTOGRAPHIC COPYING MACHINE

BACKGROUND OF THE INVENTION

1. Field of the Invention

The present invention relates to a drum cleaning blade for an electrophotographic copying machine. In a transfer type of the electrophotographic copying machine, there is in general employed a rotatable drum provided with a photoconductive light sensitive layer on the cylindrical outer surface therof in which an electrostatic latent image is formed. The latent image is then developed to a toner image which is in turn transferred to a transfer sheet to be recorded. After the image transfer, it is generally required to remove the toner paricles from the durm surface.

To this end, the electrophotographic copying machine has a drum cleaning apparatus which includes a drum cleaning blade often referred to as the doctor blade.

The present invention relates to such doctor blade (hereinafter referred to simply as blade).

2. Description of the Prior Art

A schematic view of a fundamental arrangement of a hitherto known drum cleaning apparatus is shown in FIG. 1. A drum 1 having a circumferential photo-conductive layer is rotated in the direction indicated by an arrow.

A blade 2 is held at a preselected fixed position in an inclined state by a holder 4 so that the lower edge of the blade 2 bears on the outer surface of the cylindrical drum against the rotating direction thereof.

The blade 2 is formed of a sheet material having resiliency and has the contacting lower edge in a straight configuration so as to assure a uniform contact with the cylindrical outer surface of the drum 1. The toner particles deposited on the drum surface are scraped off, as the lower edge of the blade 2 is in slidable engagement relative to the outer cylindrical surface of the drum 1.

Reference numeral 5 denotes a guide plate for collecting the toner particles, which is disposed in an inclined state with the upper edge thereof bearing on the outer cylindrical surface of the drum at a position below and upstream of the blade 2 as viewed in the rotating direction indicated by an arrow.

The toner particles as scraped off by the blade 2 will slide down along the drum surface onto the guide plate or chute 5, whereby the toner particles are introduced into a collecting container (not shown) having an inlet opening receiving therein the lower edge of the guide plate 5.

In the drum cleaning apparatus having the scraping blade 2 as described above, the toner particles will be scattered laterally and fall from the both sides of the drum 1 and/or guide plate 5. Such undesirable phenomenon will become more remarkable in the case in which feeble transverse vibrations are applied to the scraping blade with a view to enhancing the scraping efficiency.

As an attempt to dispose of the difficulty described above, it has been heretofore known and also widely adopted that side portions of the drum 1 are stretched outwardly beyond the side edges of the blade 2.

However, in order that such arrangement is to be practically effective, the lateral exension d of the drum 1 will amount to 30 to 40 mm, when the side edge of the guide of the guide plate 5 is extended for 5 mm laterally from the adjacent side edge of the blade 2.

As a result, the overall length of the drum 1 has to be longer than that of the blade 2 by 60 to 80 mm.

Consequently, the drum which is inherently to serve as the carrier for the photo-sensitive layer for producing an electrostatic latent image to be developed by the toner particles must have relatively large side portions which play no part as the carrier for the photo-sensitive layer, while the opening of the toner collecting container has to be of correspondingly increased size, involving high costs of the copying machine as well as an enlarged structure thereof, against a prevailing demand for miniaturization.

As an approach for eliminating the difficulty described above, it has been also heretofore known that a circumferential groove 6 is formed at each side of the drum, while the blade 2 is provided with projections 7 at both sides each of which is adapted to be slidably fitted in the associated groove 6. With this arrangement, it is necessary to hold the blade 2 in a strictly defined position relative to the rotating drum 1, involving increased manufacturing costs, notwithstanding the impossibility of attaining the miniaturization desired.

SUMMARY OF INVENTION

Accordingly, an object of the invention is to provide a scraping blade of a novel and improved structure which is capable of preventing the toner particles from being scattered laterally of the drum, without requiring any modifications to the drum itself.

In view of the above and other objects which will become apparent as description proceeds, there is proposed according to a general aspect of the invention a drum cleaning blade for an electrophotographic copying machine which has a rotatable drum having a photo-sensitive cylindrical surface in which an electrostatic latent image of an original to be copied is produced and developed by a toner, including a sheet-like major portion having a straight lower edge, a pair of projections extending forwardly at both sides of the major portion and having respective slanted inner edges facing inwardly in opposition to each other, the inner edges being continuous to and inclined laterally outwardly relative to the straight lower edge of the major portion so that said projections are tapered forwardly, and cuts fromed in the major portion, each starting from a junction between the straight lower edge and each of the slanted inner edges, wherein the straight lower edge and the slanted inner edges are adapted to bear on the outer cylindrical surface of the drum, thereby to scrape off toner particles deposited on the drum surface as the drum is rotated relative to the cleaning blade.

The above and other objects, novel features and advatages of the invention will become more apparent from description of the preferred embodiments of the invention taken in conjunction with the accompanying drawings.

DETAILED DESCRIPTION OF THE PREFERRED EMBODIMENTS

Figure 1:
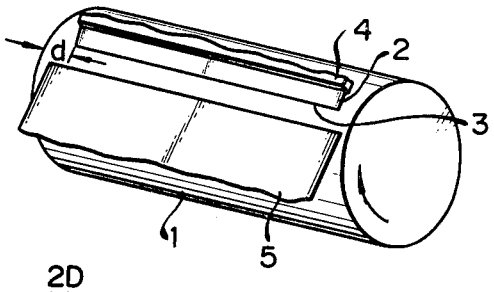
FIG. 1 PRIOR ART
FIG. 1 is a perspective view to schematically show a hitherto known structure of a drum cleaning apparatus for an electrophotographic copying machine.
Figure 3:
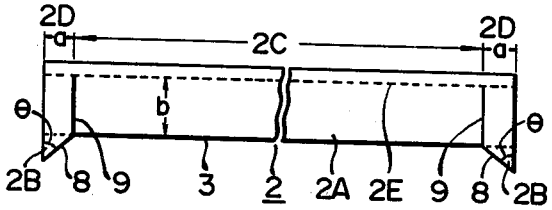
FIG. 3 is a top plan view showing a drum cleaning blade according to an embodiment of the invention.
Figure 2:
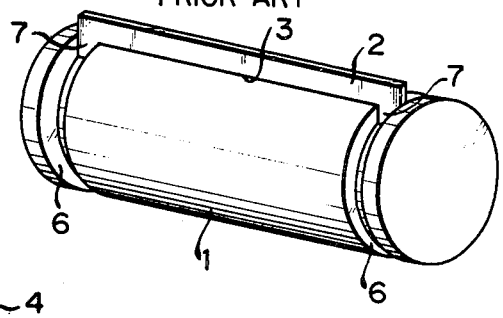
FIG. 2 PRIOR ART
FIG. 2 is a perspective view showing another example of the drum cleaning apparatus of a hitherto known structure.

Referring to FIG. 3, the drum cleaning blade according to an embodiment of the invention includes a rectangular major portion 2A as indicated by a broken line having a straight lower edge 3 and a pair of triangular side projections 2B provided at both sides of the lower edge 3, each having a slanted inner edge 8 tapered outwardly. The edge 8 of each triangular projection 2B is formed to be continuous to the lower edge 3 of the main portion 2A.

Each of the side portions having respective triangular projections 2B are separated from the center portion 2C having the straight lower edge 3 along a linear cut 9 extending from the inner end of the slanted edge 8 of the triagular projection 2B perpendicularly to the lower edge 3. Thus, the blade 2 can be divided into the center major portion 2C and the side portions 2D as shown in FIG. 3.

The blade 2 is made of an elastic or resilient material such as chloroprene, urethane rubber or the like. The width a of the side portion 2D is selected greater than 1 mm and preferably greater than 3 mm, while the inclination of the slanted edge 8 of the triangular projection 2B is selected such that the angle $\theta$ defined in FIG. 3 is in the range of 10° to 75° and more preferably in the range of 10° to 50°. Upper edge portion 2E shown as defined by the broken line is adapted to be held by the holder 4. It should be mentioned that the side portions 2D and the center major portion 2C may be made either of the same material or different materials.

Figure 4:
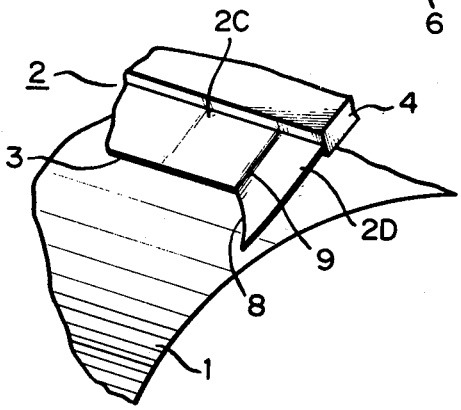
FIG. 4 is a fragmental perspective view of the drum cleaning blade according to the invention to illustrate the operation thereof.

With the structure of the blade 2 described above, when the blade 2 is held by the holder 4 at the upper edge portion and brought into contact with the cylindrical outer surface of the drum 1 in an inclined state relative to the drum surface as is shown in FIG. 4, the lower edge 3 of the center portion 2C is caused to bear on the drum surface under uniform pressure along the whole length, while the inner edges 8 of the side portions 2D will be slightly arcuate due to the cylidrical outer surface of the drum 1.

In other words, the blade 2 is formed with flanges at both sides thereof extending forwardly against the rotating direction of the drum 1, whereby the lateral scattering of the toner particles can be positively prevented by the side projections 2B. Because the center portion 2C is separated from the side portions 2D bent arcuately by the linear cuts 9, the former is not subjected to any undesirable force from the bent side portions 2D, whereby the lower edge 3 of the center portion 2C is maintained in contact with the outer cylidrical surface of the drum 1 in a satisfactory manner.

Since the slanted inner edges 8 of the side portions 2D face downwardly and inwardly toward the center portion of the drum cylidrical surface, the toner particles deposited on the lateral side portions of the drum surface and likely to be scattered laterally will undergo the scraping force of the corresponding direction, whereby the tendency of toner particles to be scattered laterally from the drum 1 can be positively suppressed. Such effect can be accomplished more significantly when feeble vibration is applied to the blade 2 in the logitudinal direction, since then the toner particles are scraped off by the inner slanted edge 8 upon the inward movement of the blade 2.

As will be appreciated from the foregoing description, the tendency of the toner particles to be scattered laterally outwardly from the drum 1 and the blade 2 can be effectively suppressed by the scraping blade itself, whereby the length of the extension of the drum can be remarkably reduced for a given length of the blade 2.

In a practical example of the blade according to the invention, made of urethane rubber having a hardness of 65° in which dimension a is equal to 4 mm, b (the effective width of the center portion 2C) is equal to 10 mm and $\theta$ is selected equal to 40°, and which is disposed with a relief angle of 17° (i.e. the angle between the blade and a tangent at a location of the cylindrical outer surface of the drum at which the edge of the blade is brought into contact), it was possible to assure a satisfactory collection of the toner particles with a length of extension d of the drum on the order of 6 mm to 8 mm which corresponds to one-fourth to one-fifth of the drum extension length in the case in which no cut 9 is formed with the other dimensions being selected the same as those described above. Thus, when the cleaning blade according to the invention is used in combination with the image transfer drum, the copying machine can be significantly miniaturized since the drum is not required to be of a great length.

Further, because any additional working such as formation of the like is unnecessary, manufacturing costs of the drum and hence the copying machine can be significantly reduced.

The blade according to the invention can be finished with a high precision through cutting of a sheet material. The possibility that gaps may be formed through expansion of the cuts 9 when the blade is caused to bear on the drum surface can be suppressed by selecting the hardness of the material, the thickness of the blade, the inclination of the lower edge relative to the drum surface, and the length of the cuts 9 at appropriate values.

While the invention has been described in conjunction with an exemplary embodiment illustrated in the drawing, it will be understood that the invention is never restricted to the disclosure but many modifications and variations may readily occur to those skilled in the art without departing from the spirit and scope of the invention.

For example, instead of the toner guide or chute plate 5, other means such as collecting rollers, belt conveyor or the like may be employed.

What is claimed is:

1. A drum cleaning blade for an electrophotographic copying machine which has a rotatable drum having a photo-sensitive cylindrical surface in which an electrostatic latent image of an original to be copied is produced and developed by a toner, comprising a sheet-like major portion having a straight lower edge, a pair of generally coplanar projections extending forwardly at both sides of said major portion and having respective slanted inner edges facing inwardly in opposition to each other, the inner edges being continuous to and inclined laterally outwardly relative to the straight lower edge of the major portion so that the projections are tapered forwardly, and cuts formed in said major portion each starting from a junction between the straight lower edge and each of the slanted inner edges, whereby the straight lower edge and the slanted inner edges formed in the projections together are adapted to bear on the cylindrical surface of the drum thereby to scrape off toner particles deposited on the surface of the drum which is rotated relative to said cleaning blade.

2. A drum cleaning blade as set forth in claim 1 wherein the major portion and the both side portions of the blade are respectively made of different resilient material.

* * * * *